US009593500B1

(12) United States Patent
Goettl

(10) Patent No.: US 9,593,500 B1
(45) Date of Patent: Mar. 14, 2017

(54) METHODS AND APPARATUSES TO RELIEVE EXCESSIVE SUCTION WITHIN SWIMMING POOL SKIMMERS

(71) Applicant: GSG Holdings, Inc., Chandler, AZ (US)

(72) Inventor: John M. Goettl, Phoenix, AZ (US)

(73) Assignee: GSG HOLDINGS, INC., Chandler, AZ (US)

( * ) Notice: Subject to any disclaimer, the term of this patent is extended or adjusted under 35 U.S.C. 154(b) by 100 days.

(21) Appl. No.: 14/496,201

(22) Filed: Sep. 25, 2014

Related U.S. Application Data

(60) Provisional application No. 61/882,544, filed on Sep. 25, 2013.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1, 167.19, 416.1, 416.2
See application file for complete search history.

(56) References Cited

U.S. PATENT DOCUMENTS

| | | | | |
|---|---|---|---|---|
| 3,706,379 | A * | 12/1972 | Erlich | E04H 4/1272 210/123 |
| 5,672,271 | A * | 9/1997 | Dye | E04H 4/1272 210/167.12 |
| 5,830,350 | A | 11/1998 | Voss et al. | |
| 6,022,481 | A | 2/2000 | Blake | |
| 7,300,576 | B1 | 11/2007 | Blake | |
| 7,563,365 | B2 | 7/2009 | Pellington et al. | |
| 2016/0341326 | A1 * | 11/2016 | Prior | F16K 21/18 |

* cited by examiner

*Primary Examiner* — Fred Prince
(74) *Attorney, Agent, or Firm* — Booth Udall Fuller, PLC

(57) ABSTRACT

A pool skimmer including an upper skimmer housing, a lower skimmer housing, a channel, and a fluid path is disclosed. The upper skimmer housing includes a pool throat opening having an upper wall and a lower wall, a deck throat opening, and a skimmer rim. The channel extends from a channel lower end positioned between the skimmer rim and an outer wall of the upper skimmer housing to a channel upper end positioned at an elevation that is least halfway between the lower wall and the upper wall. The lower skimmer housing includes a pump inlet port, a pool return port, and one or more pump suction ports. The fluid path extends from the one or more suction ports to the channel to allow fluid communication between the one or more suction ports and the channel upper end when a basket is mounted to the skimmer rim.

19 Claims, 8 Drawing Sheets

METHODS AND APPARATUSES TO RELIEVE EXCESSIVE SUCTION WITHIN SWIMMING POOL SKIMMERS

CROSS REFERENCE TO RELATED APPLICATIONS

This document claims the benefit of the filing date of U.S. Provisional Patent Application 61/882,544, entitled "Methods and Apparatuses to Relieve Excessive Suction within Swimming Pool Skimmers" to Goettl which was filed on Sep. 25, 2013, the contents of which are hereby incorporated by reference.

BACKGROUND

1. Technical Field

Aspects of this document relate generally to pool skimmer systems.

2. Background Art

Most swimming pools have a skimming device connected to the suction of a pump to draw water from the pool at or very near the pool surface. These devices usually include a basket or strainer to separate larger debris such as leaves and other floating particles. Water drawn from the skimmer can be connected to the suction of a pump that is connected to a typical swimming pool filter system and returned back to the pool in one or more ordinary ways well known in the art. It is common to connect the suction of several pumps to a skimmer in order to enhance skimming action. There are skimmers, commonly called venturi skimmers, equipped with a pressure jet located to entrain water within the skimmer and eject it back to the pool through a relatively short, unobstructed conduit. This method produces a significant flow increase through the skimmer, resulting in improved surface debris entrapment.

Typically, the pump suction connected to a skimmer is also connected to one or more other drains within the pool. This provides protection to the skimmer basket should it become blocked by debris. The suction is simply diverted to the other drain thereby protecting the skimmer basket from deformation or bursting.

In the case of a venturi skimmer, when the debris basket becomes blocked the venturi return line becomes a point of suction that can be very dangerous to a bather. When the suction of a pump is connected to a Venturi-type skimmer, the flow through the venturi return is reversed when the basket becomes full due to the suction of the separately attached pump.

There are skimming devices that provide air relief in an effort to solve the forgoing problems. U.S. Pat. No. 5,830,350 to Price describes a skimmer basket that has a central perforated pylon extending from the basket bottom to above the basket rim. The pylon consumes a portion of the basket capacity and is difficult to manufacture. U.S. Pat. No. 7,300,576 to Blake describes a conventional Venturi skimmer with an external tube running from the upper interior of the main skimmer body to a location below the skimmer basket in the main skimmer body. This method results in a necessarily small tube on the exterior of the skimmer. This small tube is costly to manufacture and very difficult to clean due to the 90 degree turns associated with the small tube. Furthermore, the chance of damaging the skimmer during the construction process is also increased due to its exterior nature.

SUMMARY

According to one aspect, a pool skimmer comprises a skimmer housing, a channel, and a fluid path. The skimmer housing comprises an upper skimmer housing and a lower skimmer housing. The upper skimmer housing comprises a pool throat opening having an upper wall and a lower wall, a deck throat opening, a basket opening, and a skimmer rim proximate the basket opening. The lower skimmer housing comprises a skimmer bottom and one or more pump suction ports. The channel extends from a channel lower end positioned between the skimmer rim and an outer wall of the upper skimmer housing to a channel upper end positioned at an elevation that is least halfway between the lower wall and the upper wall of the upper skimmer housing. The fluid path extends from the one or more suction ports to the channel to allow fluid communication between the one or more suction ports and the channel upper end when a basket is mounted to the skimmer rim of the upper skimmer housing.

Various implementations and embodiments of a pool skimmer may include one or more of the following. The channel upper end may be proximate the deck throat opening of the upper skimmer housing. The channel may be formed between the outer wall of the upper skimmer housing and a channel inner wall coupled to the upper skimmer housing, and the lower skimmer housing may comprise a pump inlet port and a pool return port. The channel may be further formed between two channel end walls positioned approximately 180 degrees from one another. The channel may be further formed between two channel end walls positioned between approximately 45 and approximately 135 degrees from one another. A slideable riser slidably mounted within the channel such that a portion of the slideable riser extends out of the channel beyond the deck throat opening and the fluid path extends from the one or more suction ports to the channel and the slideable riser to allow fluid communication between the one or more suction ports and the slideable riser beyond the deck throat opening. The pump inlet port may comprise a venturi nozzle, the pool return port may comprise a venturi return, the one or more pump suction ports may comprise two pump suction ports, and the pool skimmer further comprises a basket mounted on the skimmer rim and extending through the basket opening and wherein the fluid path is outside the basket. The one or more pump suction ports may extend through a middle portion of the skimmer bottom, and the pump inlet port and the pool return port may be positioned over a side portion of the skimmer bottom such that the pump inlet port and the pool return port are offset from the one or more pump suction ports.

According to another aspect, a pool skimmer comprises a skimmer housing, a channel, and a basket. The skimmer housing comprises an upper skimmer housing and a lower skimmer housing. The upper skimmer housing comprises a pool throat opening having an upper wall and a lower wall, a deck throat opening, a basket opening, and a skimmer rim proximate the basket opening. The lower skimmer housing comprises a skimmer bottom and one or more pump suction ports. The channel extends from a channel lower end positioned between the first basket opening and an outer wall of the upper skimmer housing to a channel upper end positioned at least halfway between the lower wall and the upper wall of the upper skimmer housing, the channel being in fluid communication with the one or more pump suction ports of the lower skimmer housing. The basket is mounted to the skimmer rim and extends through the basket opening, the basket being sized such that porous walls of the basket are at least 0.5 inches from the lower skimmer housing.

Various implementations and embodiments of a pool skimmer may comprise one or more of the following. The channel upper end may be proximate the deck throat opening of the upper skimmer housing. The channel may be formed between the outer wall of the upper skimmer housing and a channel inner wall coupled to the upper skimmer housing, and the lower skimmer housing may comprise a venturi nozzle coupled to a pump inlet port, and a pool return port. The channel may be formed between two channel end walls positioned approximately 180 degrees from one another. The channel may be formed between two channel end walls positioned between approximately 45 and approximately 135 degrees from one another. A slideable riser slidably mounted within the channel such that a portion of the slideable riser extends out of the channel beyond the deck throat opening. The one or more pump suction ports extend through a middle portion of the skimmer bottom, and the pump inlet port and the pool return port may be positioned over a side portion of the skimmer bottom such that the pump inlet port and the pool return port are offset from the one or more pump suction ports.

According to another aspect, a pool skimmer comprises a skimmer housing and a channel. The skimmer housing comprises a pool throat opening, a deck throat opening, a skimmer rim, and one or more pump suction ports. The channel extends from a channel lower end positioned between the first basket opening and an outer wall of the skimmer housing to a channel upper end positioned at least halfway between the lower wall and the upper wall of the upper skimmer housing such that a fluid path is formed between the upper end of the channel and the pump suction port.

Various implementations and embodiments of a pool skimmer may comprise one or more of the following. A pool basket mounted to the skimmer rim and comprising one or more porous walls, the pool basket being sized such that the one or more porous walls are at least approximately 0.5 inches from the outer wall of the skimmer housing. The channel upper end may be proximate the deck throat opening of the upper skimmer housing, and the skimmer housing may further comprise a pump inlet port and a pool return port. A slideable riser slidably mounted within the channel such that a portion of the slideable riser extends out of the channel beyond the deck throat opening. The pump inlet port comprises a venturi nozzle, the pool return port comprises a venturi return, the one or more pump suction ports comprise two pump suction ports. The channel may be formed between the outer wall of the upper skimmer housing, a channel inner wall coupled to the upper skimmer housing, and two channel end walls positioned between approximately 90 and approximately 180 degrees from one another. The one or more pump suction ports may extend through a middle portion of a skimmer bottom of the lower skimmer housing, and the pump inlet port and the pool return port may be positioned over a side portion of the skimmer bottom such that the pump inlet port and the pool return port are offset from the one or more pump suction ports.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool skimmer systems and/or assembly procedures for pool skimmer systems will become apparent for use with implementations of pool skimmer systems from this disclosure. Accordingly, for example, although particular pool skimmer systems are disclosed, such pool skimmer systems and implementing components may comprise any shape, size, style, type, model, version, measurement, concentration, material, quantity, and/or the like as is known in the art for such pool skimmer systems and implementing components, consistent with the intended operation of pool skimmer systems.

Figure 1:
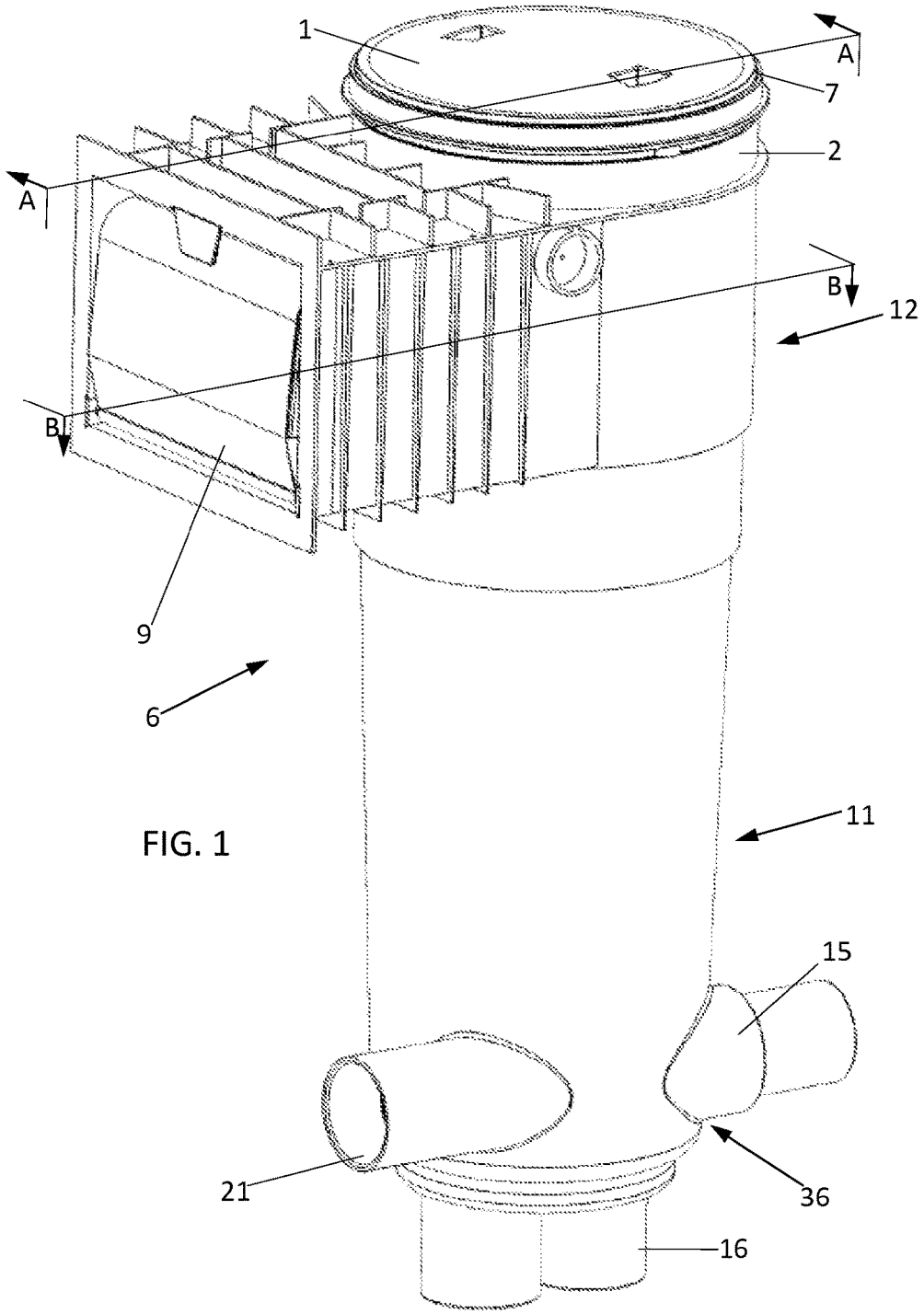
FIG. 1 is a perspective view of a pool skimmer system.

FIG. 1 depicts a non-limiting embodiment of a pool skimmer housing of a pool skimmer system 6. Reference is made throughout this document to an upper skimmer housing 12 and a lower skimmer housing 11. It is contemplated that the upper skimmer housing 12 and the lower skimmer housing 11 may comprise two separate and individual pieces coupled together, or a single piece integrally formed during manufacture. In the non-limiting embodiment depicted in FIG. 1, the upper skimmer housing 12 and the lower skimmer housing 11 comprise two separate pieces coupled together. It is further contemplated embodiments of a pool skimmer system 6 in general and a pool skimmer housing referenced in this document may comprise various features of a pool skimmer housing previously known in the art, such as but not limited to a pool throat opening 3 having an upper wall 17 and a lower wall 18 (shown in FIG. 2), a weir 9 hingedly or otherwise pivotally coupled to the upper skimmer housing 12 proximate a pool throat opening 3, a deck closure or cover 1 coupled to the upper skimmer housing 12 proximate a deck throat opening 5, one or more pump suction ports 16 on a bottom 20 of the lower skimmer housing 11, a finish edge 7, a skimmer interior wall 4, a deck ring 2, and the like. In one or more embodiments, the pool surface elevation is approximately one-half of the pool throat opening 3, or halfway between the upper wall 17 and the lower wall 18 of the pool throat opening 3. However, the pool elevation can vary from upper elevation at the upper wall 17 to a lower elevation at the lower wall 18 due to increased bather influx, rain, insufficient make up water, and other reasons known in the art. Some skimmer embodiments are adapted with an overflow port to limit and provide an attachment point of piping to carry away overflow to a suitable area away from the pool. Normally, the maximum water containing height of a pool is approximately upper elevation at the upper wall 17.

The skimmer housing typically further comprises a basket opening positioned within the pool skimmer housing and sized to house a basket 10. To facilitate housing of the basket 10 within the skimmer housing, the upper skimmer housing 12 comprises a first basket opening 61 and the lower skimmer housing 11 comprises a second basket opening 62 aligned with the first basket opening 61.

Figure 2:
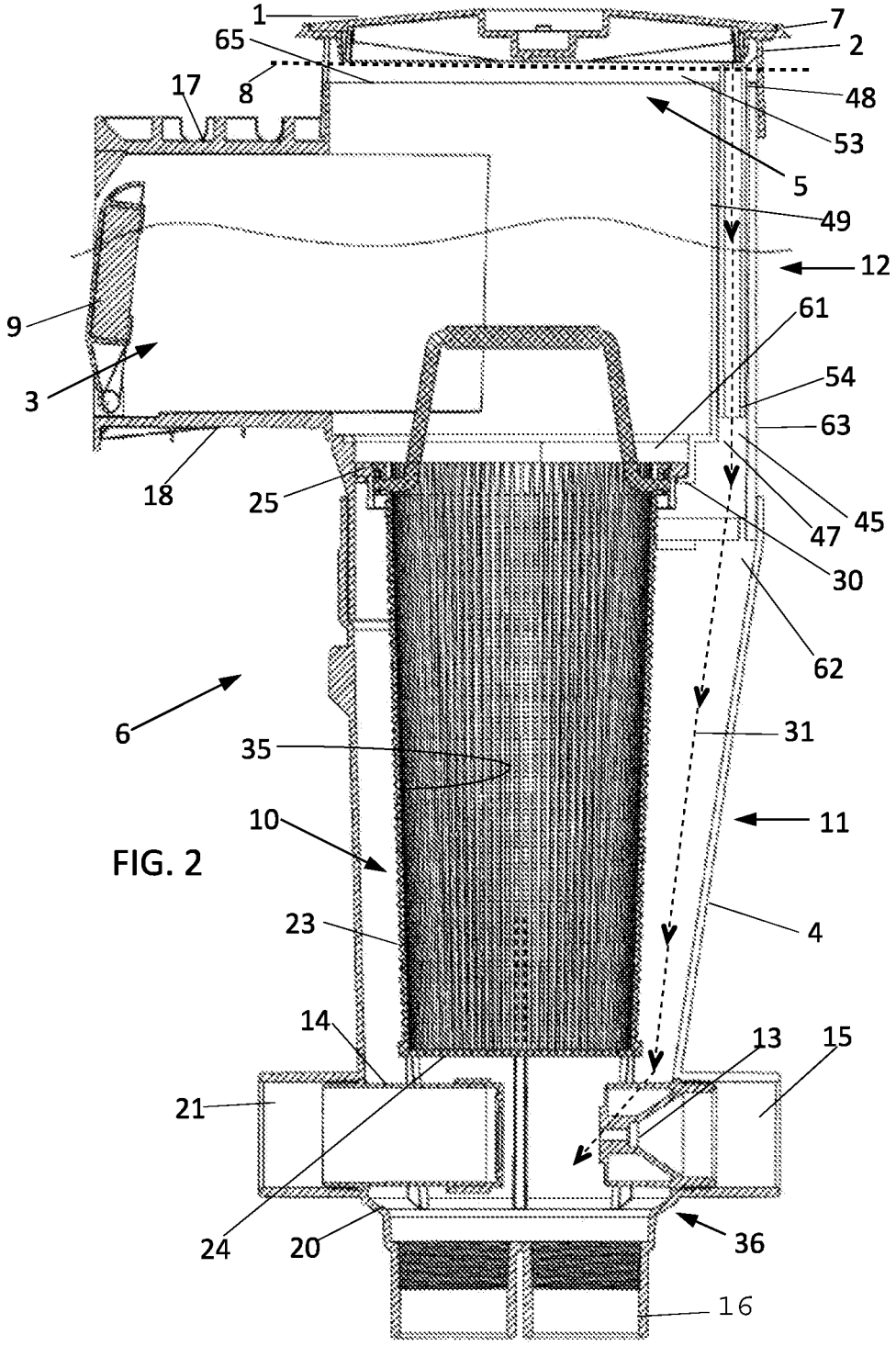
FIG. 2 is a cross sectional view of a pool skimmer system taken along sectional line A-A of FIG. 1.

Additionally, the lower skimmer housing 11 may comprise a venturi system 36 (shown in FIG. 2). The venturi system typically comprises a pump inlet port 15 having a venturi nozzle 13 coupled thereto and a pool return port 21 having a venturi sleeve 14 coupled thereto. The venturi system 36 may operate as is known to those having ordinary skill in the art. For example, a pool pump associated with the system may pull water in the skimmer housing into the one or more pump suction ports 16 or any other suction ports known in the art, push water into the skimmer housing through the pump inlet port 15, and push water into the pool return port 21 to return filtered water back into the pool and create a high velocity flow to entrain water in the skimmer housing, thereby creating an increased flow through the skimmer. The one or more conventional pump suction ports 16 are configured for connection of additional pump or pump suction and drain connection in the conventional manner.

In one or more embodiments, the upper skimmer housing 12 comprises a skimmer rim 30 proximate the first basket opening 61. FIG. 2 depicts a cross sectional view taken along line A-A in FIG. 1 of a non-limiting embodiment of a skimmer system that includes a skimmer rim 30. According to some aspects, the skimmer rim 30 is a continuous rim that forms a boundary of the first basket opening 61. The skimmer rim 30 is configured to engage with a portion of the basket 10, typically the basket rim 25 to hold the basket in an operable position within the skimmer housing. The skimmer rim 30 is, therefore, typically shaped complementary to the shape of skimmer basket 10. In some embodiments, the skimmer rim 30 is substantially level with the lower wall 18 of the skimmer throat opening 3, while in other embodiments, such as the non-limiting embodiment depicted in FIG. 2, the skimmer rim 30 is positioned below the lower wall 18 of the skimmer throat opening 3.

One or more embodiments of a skimmer system 6 further comprise a channel 45 formed between an outer wall 63 of the upper skimmer housing 12 and a channel inner wall 49 of the upper skimmer housing 12. The channel 45 extends from a lower end 47 to an upper end 48. The lower end 47 is typically positioned between the skimmer rim 30 and the outer wall 63 of the upper skimmer housing 12. Thus, the lower end 47 may be positioned at an elevation that is substantially level with or lower than the lower wall 18 of the pool throat opening 3. In some embodiments, such as the non-limiting embodiment depicted in FIG. 2, the channel 45 narrows between the level of the skimmer rim 30 and the level of the lower wall 18 of the pool throat opening 3.

The upper end 48 of the channel 45 is typically positioned at an elevation 8 that is at least halfway between the lower wall 18 and upper wall 17 of the pool throat opening 3. In more particularly embodiments, the channel 45 extends to an upper end 48 that is at an elevation that is at least level with the upper wall 17 of the pool throat opening 3. In still more particular embodiments, such as the non-limiting embodiment depicted in FIG. 2, the channel 45 extends to an upper end 48 that is at an elevation that is above the level of the upper wall 17. In such embodiments, the channel 45 extends to the top end 65 of the deck throat opening 5 of the upper skimmer housing 12. At the top end 65 of the deck throat opening 5, an end chamber 53 is formed by the deck ring 2, the finish edge, and the deck closure 1 and the deck throat opening 5. Because the end chamber is positioned above the upper wall 17 of the pool throat opening 3, the end chamber 53 will always have air held therein.

Figure 3:
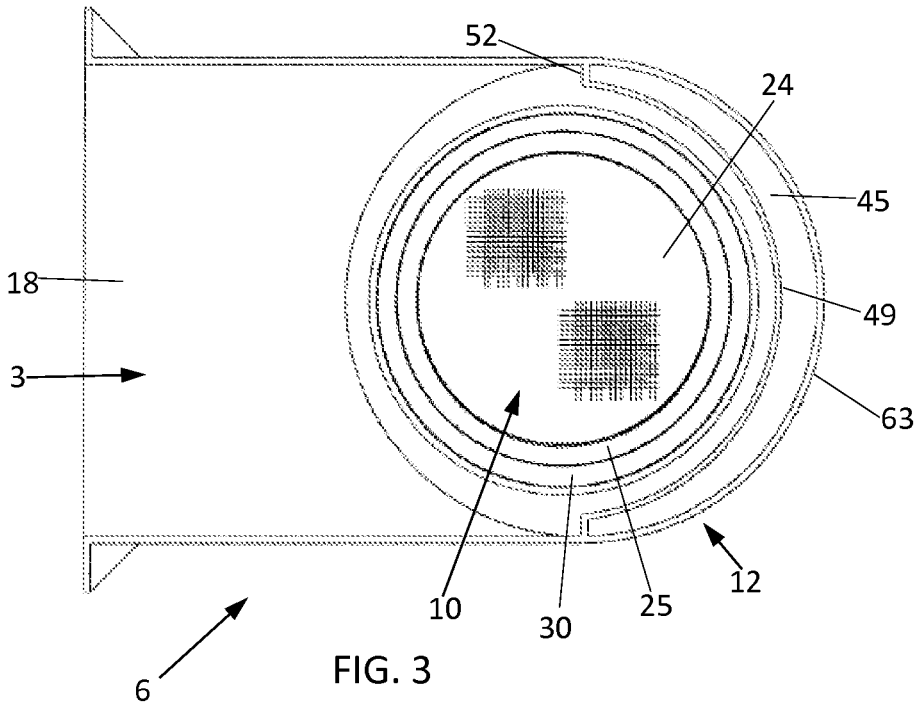
FIG. 3 is a cross sectional view of a pool skimmer system with a first embodiment of a channel taken along sectional line B-B of FIG. 1.

Various embodiments of pool skimmer systems may comprise channels of different sizes and configurations. For example, in the not limiting embodiment depicted in FIGS. 2 and 3, the channel 45 arcs approximately 180 degrees between two channel end walls 52. In other embodiments, such as the non-limiting embodiment of a pool skimmer system 70 depicts in FIG. 4, the channel 75 arcs approximately 90 degrees between two channel end walls 72. Like other embodiments, the channel 75 is formed between an inner wall 71 and an outer wall 63 of an upper skimmer housing 12 and includes an upper end and lower end as described in relation to the channel 45. In such an embodiment, the slidable riser 74 is sized to slidably position within the channel 75. In still other embodiments, a channel may arc greater than 180 degrees, between 135 and 180 degrees, between 90 and 135 degrees, between 45 and 90 degrees, or less than 45 degrees. According to some aspects, the size of the air chamber 45 is significant because if the air chamber 45 is too small for the application, the safety suction release may be insufficient to prevent suction entrapment. If the size of the air chamber 45 is too large, the manufacturing costs may be unnecessarily increased.

In some non-limiting embodiments, the outer wall 63 of the channel is flush with the upper skimmer housing 12 and the channel inner wall 49 is positioned within the upper skimmer housing 12. This results in a smooth exterior shape, which may be preferable for imbedding in concrete as is commonly done. Alternately, the channel 45 may be positioned as an exterior offset rather than an interior offset. In such embodiments, the channel inner wall 49 may be flush with the upper skimmer housing 12 and the outer wall 63 may protrude outwardly from the upper skimmer housing 12.

According to some aspects, a pool skimmer system 6 further comprises a slidable riser 54. The slidable riser 54 is shaped complementary to the channel 45 and configured to slidably mounted within the channel 45. The slidable riser 54 typically comprises a passage extending through the riser 54 and allows a user to extend the fluid path 31 beyond the top end 65 of the upper skimmer housing 12. For example, when the riser 54 extends above the top end 65 of the upper skimmer housing 12, the fluid path 31 extends from the one or more suction ports to the channel 45, from the channel to the passage of the riser 54, and from the passage of the riser 54 to the end chamber 53 or the open air above the top end 65 of the upper skimmer housing 12.

Figure 4:
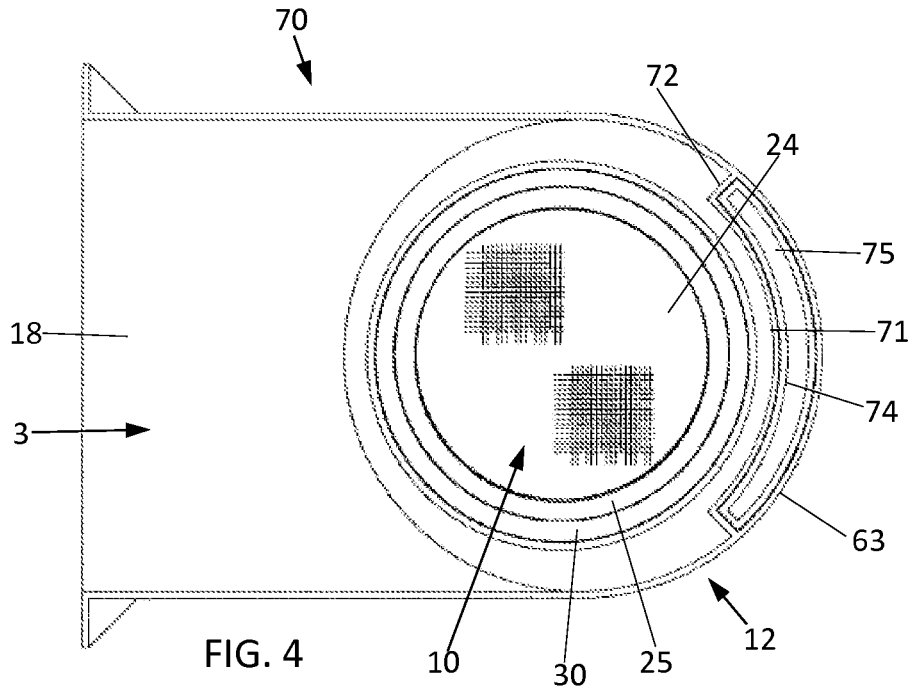
FIG. 4 is a cross sectional view of a pool skimmer system with a second embodiment of a channel taken along sectional line B-B of FIG. 1.
Figure 5:
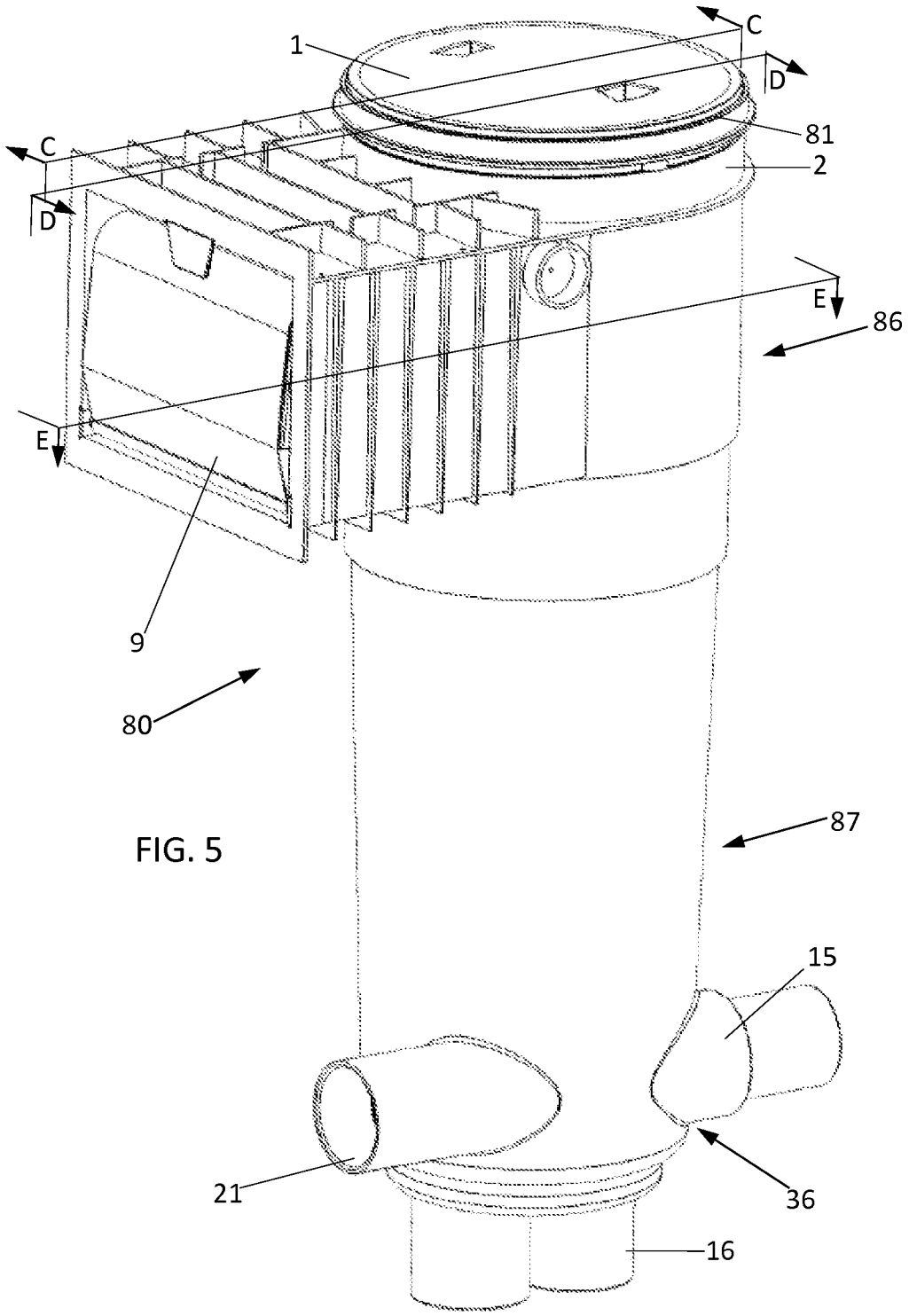
FIG. 5 is a perspective view of a second embodiment of a pool skimmer system.

As a slidable riser 54 is configured to slidably mount within the channel 45 in a substantially air tight fit, the slidable riser 54 is typically shaped complementary to the channel 45. For example, in the non-limiting embodiment depicted in FIGS. 2 and 3, the riser comprises an arc that is substantially equal or just less than the approximate 180 degree arc of the channel 45. In FIG. 4, the slidable riser 74 comprises an arc that is substantially equal to or just less than the approximate 90 degree arc of the channel 75. In other embodiments, the slidable riser comprises an arc that is substantially equal to or just less than the arc of the channel. It should be noted that some leakage of water into air chamber can be tolerated with no effect to entrapment protection as the forming ring 2 is moved up or down as is commonly done to adjust forming ring 2 to the correct deck elevation during the construction process. Atmospheric or fluid communication the channel 45 is maintained at the highest possible point providing maximum entrapment protection.

Various embodiments of a pool skimmer system 6 further comprise a basket 10. The basket 10 typically comprises an basket opening 32 at a top end of the basket 10, a porous basket bottom 24, one or more porous walls 23 extending between the top end and porous basket bottom 24, and an inner basket surface 35 within the basket 10. One or more embodiments of a basket 10 may further comprise a handle. The basket 10 is sized such that a fluid path 31 is formed between the one or more porous walls 23 and the skimmer interior walls 4 of the lower skimmer housing 11. The fluid path 31 typically comprises an open space of at least 0.5 inches from the skimmer interior wall 4 of the lower skimmer housing 11 to the porous wall 23 of the basket 10. In other embodiments, the fluid path 31 may comprise an open space of approximately 0.25 inches, 0.5 approximately inches, approximately 0.75 inches, or greater than approximately 1.0 inches from the skimmer interior wall 4 of the lower skimmer housing 11 to the porous wall 23 of the basket 10. According to some aspects, the basket 10 further comprises a basket rim 25, typically proximate the open top end of the basket 10. The basket rim 25 is configured to engage with the skimmer rim 30 and hold the basket 10 in an operable position within the skimmer housing. The pool throat opening 3 is positioned to intersect a portion of the upper end of the basket 10 when the basket is operably mounted within the housing in one or more embodiments. The width of the pool throat opening 3 and diameter of the basket 10 are substantially equal in some embodiments. In other embodiments, however, the width of the pool throat opening 3 and the diameter of the basket 10 may differ. In this way, debris will flow into the basket 10 when the pool level is within a range from the upper pool wall 17 and the lower pool wall 18.

One or more embodiments of a pool skimmer system 6 further comprise a fluid path 31 that extends between the channel 45 and the one or more pump suction ports 16. The fluid path 31 allows uninterrupted fluid communication from at least one of the pump suction ports 16 and the pool return port 21 to the upper end 48 of the channel 45 and/or the end chamber 53 even when a basket 10 is mounted in the skimmer housing. In operation, water flow may enter the pool throat opening 3 over weir 9 and continue into the basket 10, and then flow to the suction ports 16. As described above, a channel 45 may be positioned in the upper skimmer housing 12, the channel 45 allowing atmospheric or fluid communication from an upper end 48 of the channel 45 with the interior flow path 31. The channel 45 may be positioned such that atmospheric or fluid communication is allowed even when the pool level is at the upper wall 17. A normal water level, however, is usually maintained approximately mid-way between the upper wall 17 and the lower wall 18. In this way, dangerous over-suction is prevented by allowing atmosphere or air to enter the lower skimmer housing 11 through the channel 45.

It will be understood by those skilled in the art that leaves and other debris being drawn into a pool throat opening 3 are trapped in the basket 10 and generally drawn to an inner basket surface 35. Debris may continue to collect at the inner basket surface 35 until substantially all of the inner basket surface 35 is covered. Covering all of the inner basket surface 35 disrupts the flow of water into the pump suction ports 16 and may create a vacuum in the skimmer housing by conventional pump suction port(s) 16 and/or the venturi system 36. The vacuum may be great enough to deform baskets of the prior art. In the case of the pump suction being connected to conventional pump suction port(s) 16 and venturi system 36, the flow is reversed by the pump suction and causes a dangerous suction condition at pool return port 21.

In one or more of the skimmer systems described herein, the above described over-suction condition cannot occur because air is allowed to enter the upper end 48 of the channel 45 above the pool level. The highest possible vacuum in the fluid path 31 is limited to water depth between the pool return port 21 and the water level of the pool. This water depth usually does not exceed 24 inches. As the pump suction ports 16 and/or or Venturi system 36 draw water from the skimmer housing, air will be drawn into the pump suction ports 16 and/or Venturi system 36 through the channel 45 with an upper end 48 above the pool level, thereby causing suction pump (not shown) to draw in air and cease operation. When pump suction at the pump suction port 16 ceases, any reversing of the Venturi system 36 and the resultant dangerous suction at pool return port 21 will cease, or be limited, to the water depth between the pool return port 21 and the pool water level. A basket opening 32 (shown in FIG. 2) may be below the lower wall 18 of the pool throat opening 3 to maximize the skimmer operating range. The lower end 47 of the channel 45 is above basket bottom 24 and preferably above basket upper rim 25. More particularly, in some embodiments the lower end 47 of the channel 45 is positioned above an elevation of the upper basket rim 25 when the basket 10 is operably positioned within the skimmer housing.

It is evident that current invention overcomes the disadvantages by eliminating external tubing and easier maintenance. It is also apparent that if the basket is not installed the skimmer would employ the same safety features as described. In particular embodiments, the upper skimmer housing 12 and the lower skimmer housing 11 may be adapted to fit only basket of current disclosures to prevent unapproved baskets from being used. In other embodiments, any skimmer basket previously known in the art may be used. The basket rim 25 may also be adapted to form a handle for improved ease of removal of basket 10 for periodic cleaning without submerging hands in water as with prior art devices.

FIGS. 5-9 depict another non-limiting embodiment of a pool skimmer system 80. Unless otherwise specified, aspects and elements of a pool skimmer system 80 are similar to those described elsewhere in this document, such as but not limited to an upper skimmer housing 86, a lower skimmer housing 87, a weir 9, a cover 1, a pool throat opening 3 having an upper wall 17 and a lower wall 18, a basket 10, one or more pump suction ports 16, a pool return port 21, a venturi sleeve 14, a venturi nozzle 13, a pump inlet port 15, a deck throat opening 5, a first basket opening 91, a second basket opening 92, a skimmer interior wall 96 and/or a skimmer bottom 20.

Like other embodiments described herein, a pool skimmer system 80 may comprise a fluid path 88 that extends from the one or more pump suction ports 16 to an end chamber 94 at least halfway between the lower wall 18 and the upper wall 17. Typically, the end chamber 94 is above the upper wall 17 of the deck throat opening 3, as depicted in the non-limiting cross sectional view of FIG. 6. The fluid path 88 comprises all the advantages described in relation to the fluid path 31 of other embodiments. The lower skimmer housing 87 is typically configured such that the fluid path 88 extends between the sidewall 23 of the basket 10 and the interior skimmer wall 96 of the lower skimmer housing 87. Accordingly, the skimmer rim 89 on the upper skimmer housing 86 is positioned to hold the basket 10 such that a space exists between the porous walls 23 and the skimmer interior wall 96 to allow a fluid path 88 to be formed between the one or more pump suction ports 16 and the channel 83. FIG. 7 depicts a cross sectional view of the a pool skimmer system 80 with the basket 10 removed to allow an unobstructed view of the skimmer rim 89 and the first basket opening 91.

Figure 6:
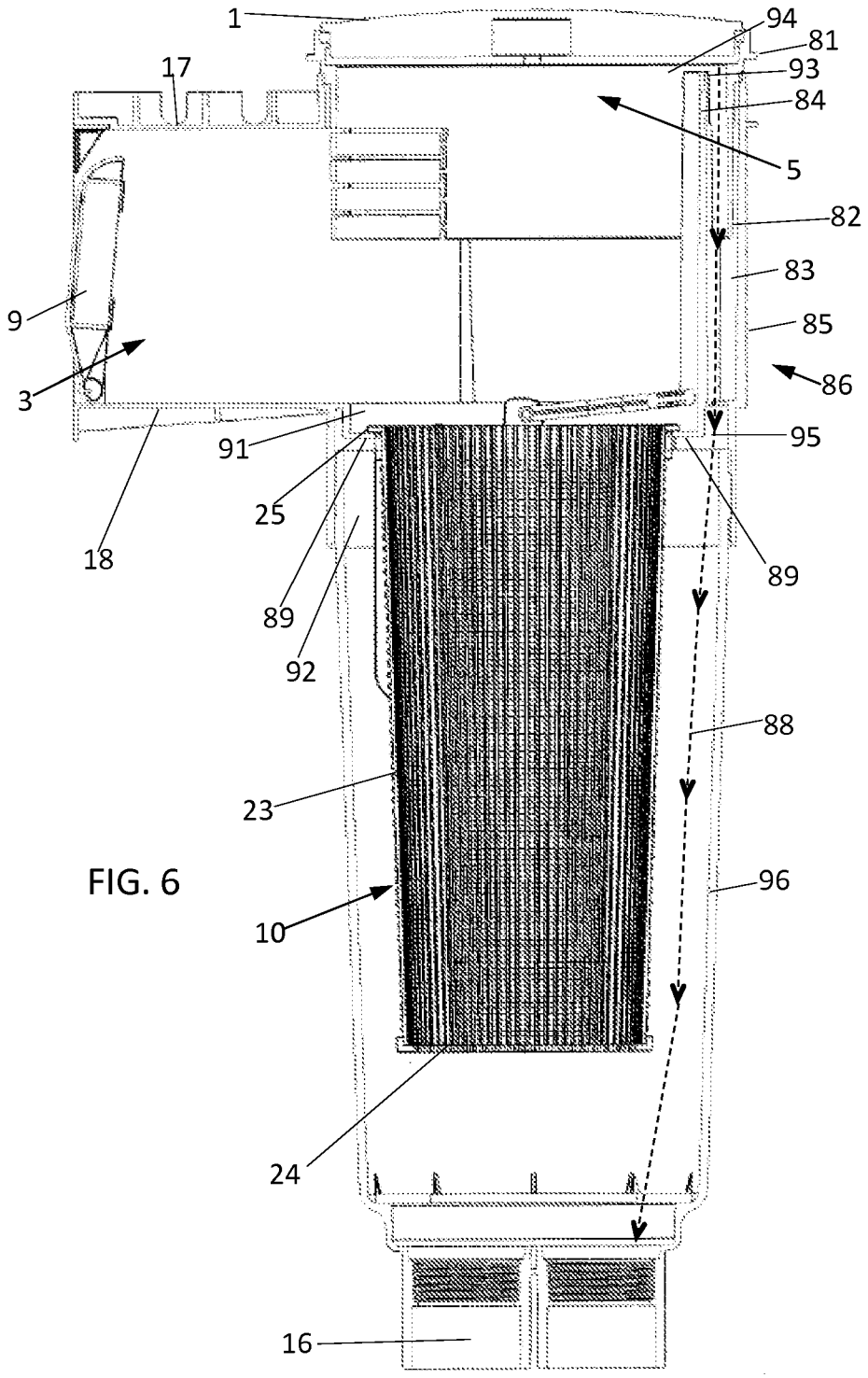
FIG. 6 is a cross sectional view of a second embodiment of a pool skimmer system taken along line C-C of FIG. 5.
Figure 7:
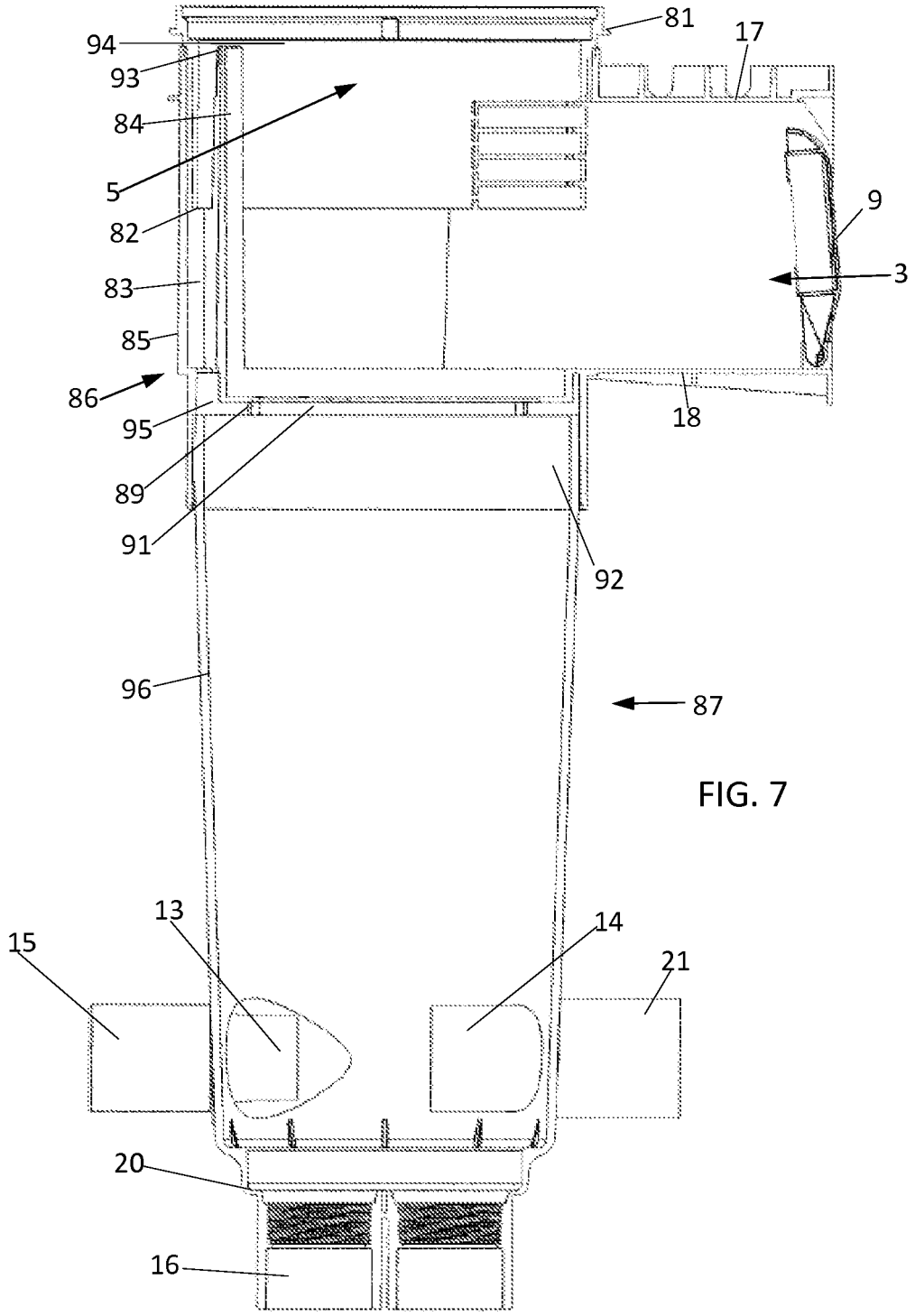
FIG. 7 is a cross sectional view of a second embodiment of a pool skimmer system taken along line D-D of FIG. 5 with the basket removed.
Figure 8:
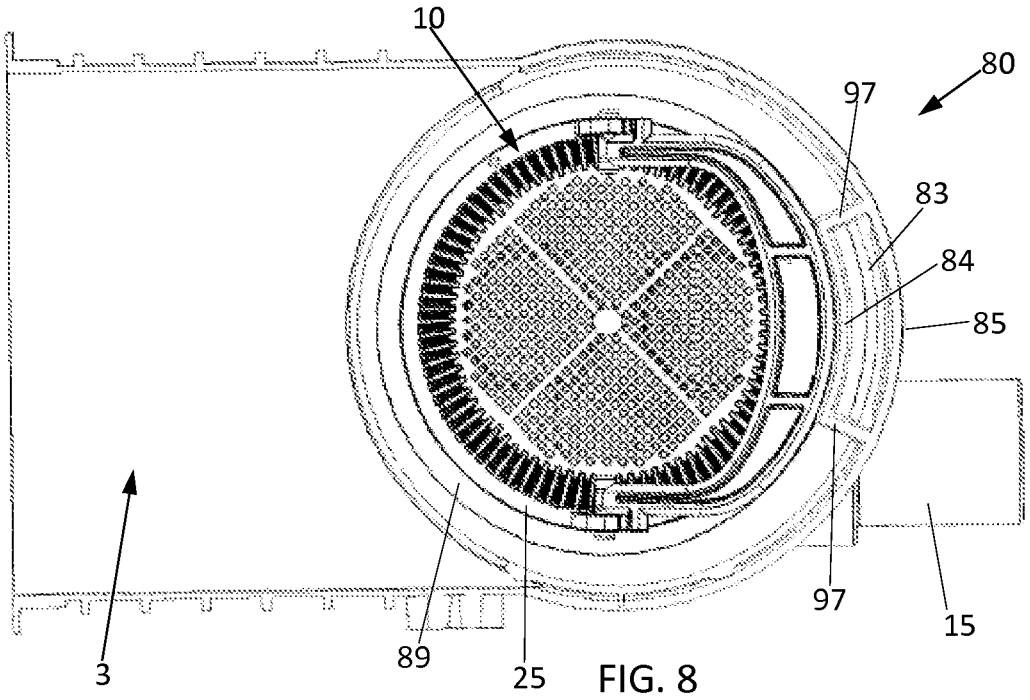
FIG. 8 is a cross sectional view of a second embodiment of a pool skimmer system taken along line E-E of FIG. 5.

Cross sectionals view presented in FIGS. 6 and 7 further depict another embodiment of a channel 83 that is configured to allow fluid communication between the an end chamber 94 and the fluid path 88 adjacent the basket 10. In one or more embodiments, a channel 83 is formed between a channel inner wall 84 and an outer wall 85 of the upper skimmer housing 86. The channel 83 typically extends from a lower end 95 that is level with or below the lower wall 18 of the pool throat opening 3 to an upper end 93 that is at least halfway between the lower wall 18 and the upper wall 17 of the pool throat opening. More particularly, the upper end 93 of the channel is positioned level with or higher than the upper wall 17 of the pool throat opening, such as the non-limiting embodiment depicted in FIGS. 6 and 7. The channel 83 is bordered on opposing sides by end walls 97 (shown in FIGS. 8 and 9). As described in other embodiments, the end walls 97 may be placed at varying degrees from one another. In the non-limiting embodiment depicted in FIGS. 8 and 9, the end walls 97 are positioned less than 90 degrees from one another. More particularly, the end walls are positioned between 30 and 60 degrees from one another. In operation, the channel 83 may function similar to other channels 45 described herein. For example, the channel 83 typically provides fluid communication between the end chamber 94 and the fluid path 88 between the basket 10 and the skimmer interior wall 96.

Figure 9:
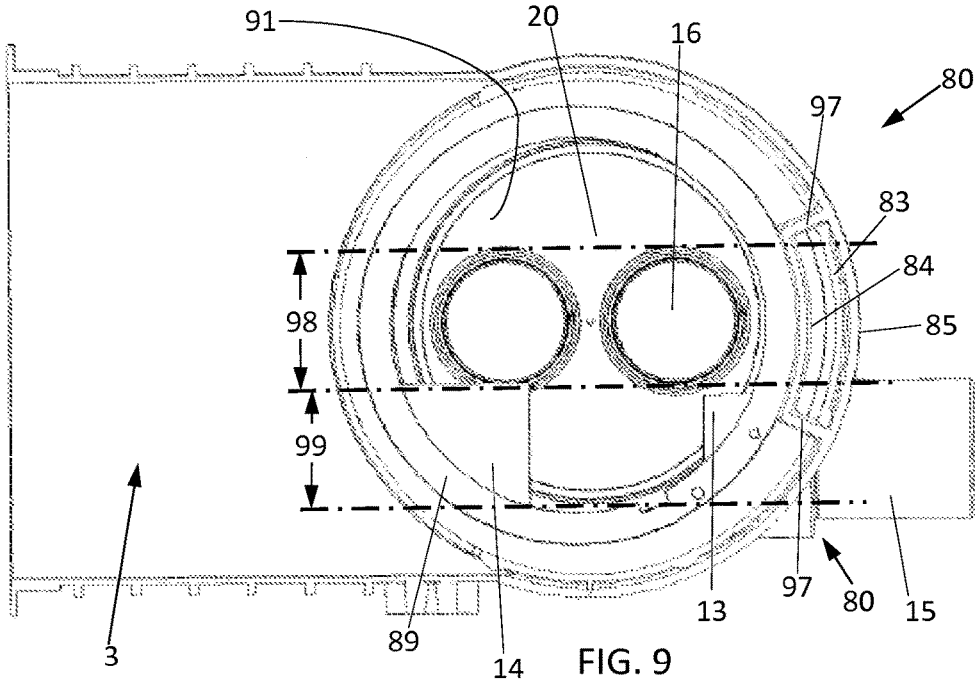
FIG. 9 is a cross sectional view of a second embodiment of a pool skimmer system taken along line E-E of FIG. 5 with the basket removed.

In one or more embodiments, the one or more pump suction ports 16 proximate on the bottom 20 of the lower skimmer housing 87 may be offset from the venturi system 36 proximate the bottom 20 of the lower skimmer housing 87 when viewed from above the pool skimmer system 80. FIG. 9 depicts a top view of a non-limiting embodiment with the basket 10 removed to provide a clear view of the offset configuration of the one or more pump suction ports 16 and the venturi system 36. More particularly, the pump suction ports 16 may be positioned within approximately a middle portion 98 of the skimmer bottom 20 while the venturi system 36 may be positioned on the sidewall of the lower skimmer housing such that the venturi system 36 is positioned over a side portion 99 of the skimmer bottom 20 relative to the middle portion of the skimmer bottom 20. Such a configuration is advantageous because it allows free access to the suction port 16 when the basket 10 is removed from the pool skimmer system 80. This access allows a user to couple a pool accessory to the pump suction port 16, such as but not limited to a vacuum hose.

According to some aspects, a pool skimmer system 80 further comprises a deck ring 81 having an arm 82 positioned to slide within the channel 83 when the deck ring 81 is coupled to the upper skimmer housing 86. The deck ring 81 is further configured to provide a break-away feature.

It will be understood that implementations are not limited to the specific components disclosed herein, as virtually any components consistent with the intended operation of a method and/or system implementation for a pool skimmer system may be utilized. Accordingly, for example, although particular housings, baskets, ports, pumps, and the like may be disclosed, such components may comprise any shape, size, style, type, model, version, class, grade, measurement, concentration, material, weight, quantity, and/or the like consistent with the intended operation of a method and/or system implementation for a pool skimmer system may be used.

In places where the description above refers to particular implementations of a pool skimmer system, it should be readily apparent that a number of modifications may be made without departing from the spirit thereof and that these implementations may be applied to other pool skimmer systems. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool skimmer, comprising:

a skimmer housing comprising an upper skimmer housing and a lower skimmer housing, the upper skimmer housing comprising a pool throat opening having an upper wall and a lower wall, a deck throat opening, a basket opening, and a skimmer rim proximate the basket opening, and the lower skimmer housing comprising a skimmer bottom and one or more pump suction ports;

a channel extending from a channel lower end positioned between the skimmer rim and an outer wall of the upper skimmer housing to a channel upper end positioned proximate the deck throat opening at an elevation that is least halfway between the lower wall and the upper wall of the upper skimmer housing, wherein the channel is formed between the outer wall of the upper skimmer housing and a channel inner wall coupled to the upper skimmer housing; and a fluid path extending from the one or more suction ports to the channel to allow fluid communication between the one or more suction ports and the channel upper end when a basket is mounted to the skimmer rim of the upper skimmer housing.

2. The pool skimmer of claim 1, wherein the lower skimmer housing comprises a pump inlet port and a pool return port.

3. The pool skimmer of claim 2, wherein the channel is further formed between two channel end walls positioned approximately 180 degrees from one another.

4. The pool skimmer of claim 2, wherein the channel is further formed between two channel end walls positioned between approximately 45 and approximately 135 degrees from one another.

5. The pool skimmer of claim 2, further comprising a slideable riser slidably mounted within the channel such that a portion of the slideable riser extends out of the channel beyond the deck throat opening and the fluid path extends from the one or more suction ports to the channel and the slideable riser to allow fluid communication between the one or more suction ports and the slideable riser beyond the deck throat opening.

6. The pool skimmer of claim 2, wherein the pump inlet port comprises a venturi nozzle, the pool return port comprises a venturi return, the one or more pump suction ports comprise two pump suction ports, and the pool skimmer further comprises a basket mounted on the skimmer rim and extending through the basket opening and wherein the fluid path is outside the basket.

7. The pool skimmer of claim 2, wherein the one or more pump suction ports extend through a middle portion of the skimmer bottom, and wherein the pump inlet port and the pool return port are positioned over a side portion of the skimmer bottom such that the pump inlet port and the pool return port are offset from the one or more pump suction ports.

8. A pool skimmer, comprising, a skimmer housing comprising an upper skimmer housing and a lower skimmer housing, the upper skimmer housing comprising a pool throat opening having an upper wall and a lower wall, a deck throat opening, a basket opening, and a skimmer rim proximate the basket opening, and the lower skimmer housing comprising a skimmer bottom and one or more pump suction ports;

a channel extending from a channel lower end positioned between the first basket opening and an outer wall of the upper skimmer housing to a channel upper end positioned proximate the deck throat opening of the upper skimmer housing at least halfway between the lower wall and the upper wall of the upper skimmer housing, the channel being in fluid communication with the one or more pump suction ports of the lower skimmer housing, wherein the channel is formed between the outer wall of the upper skimmer housing and a channel inner wall coupled to the upper skimmer housing, wherein the channel is formed between the outer wall of the upper skimmer housing and a channel inner wall of the upper skimmer housing; and a basket mounted to the skimmer rim and extending through the basket opening, the basket being sized such that porous walls of the basket are at least 0.5 inches from the lower skimmer housing.

9. The pool skimmer of claim 8, wherein the lower skimmer housing comprises a venturi nozzle coupled to a pump inlet port, and a pool return port.

10. The pool skimmer of claim 9, wherein the channel is further formed between two channel end walls positioned approximately 180 degrees from one another.

11. The pool skimmer of claim 9, wherein the channel is further formed between two channel end walls positioned between approximately 45 and approximately 135 degrees from one another.

12. The pool skimmer of claim 9, further comprising a slideable riser slidably mounted within the channel such that a portion of the slideable riser extends out of the channel beyond the deck throat opening.

13. The pool skimmer of claim 9, wherein the one or more pump suction ports extend through a middle portion of the skimmer bottom, and wherein the pump inlet port and the pool return port are positioned over a side portion of the skimmer bottom such that the pump inlet port and the pool return port are offset from the one or more pump suction ports.

14. A pool skimmer, comprising:

a skimmer housing comprising a pool throat opening, a deck throat opening, a skimmer rim, and one or more pump suction ports;

a channel extending from a channel lower end positioned between a first basket opening and an outer wall of the skimmer housing to a channel upper end positioned proximate the deck throat opening at least halfway between a lower wall and an upper wall of an upper skimmer housing such that a fluid path is formed between the channel upper end and the one or more pump suction ports;

a pool basket mounted to the skimmer rim and comprising one or more porous walls; and a slideable riser slidably mounted within the channel such that a portion of the slideable riser extends out of the channel beyond the deck throat opening.

15. The pool skimmer of claim 14, the pool basket sized such that the one or more porous walls are at least approximately 0.5 inches from the outer wall of the skimmer housing.

16. The pool skimmer of claim 15, wherein the skimmer housing further comprises a pump inlet port and a pool return port.

17. The pool skimmer of claim 16, wherein the pump inlet port comprises a venturi nozzle, the pool return port comprises a venturi return, the one or more pump suction ports comprise two pump suction ports.

18. The pool skimmer of claim 17, wherein the channel is formed between the outer wall of the upper skimmer housing, a channel inner wall coupled to the upper skimmer housing, and two channel end walls positioned between approximately 90 and approximately 180 degrees from one another.

19. The pool skimmer of claim 16, wherein the one or more pump suction ports extend through a middle portion of a skimmer bottom of the lower skimmer housing, and wherein the pump inlet port and the pool return port are positioned over a side portion of the skimmer bottom such that the pump inlet port and the pool return port are offset from the one or more pump suction ports.

* * * * *